US008453873B2

(12) United States Patent
Zielinski et al.

(10) Patent No.: US 8,453,873 B2
(45) Date of Patent: Jun. 4, 2013

(54) CLOSURE

(75) Inventors: Peter M. Zielinski, Millville, NJ (US); Garrett Hager, Lancaster, PA (US); Don F. Yeager, Millville, NJ (US); Brian M. Gatton, Franklinville, NJ (US)

(73) Assignee: Amcor Limited, Hawthorn (AU)

( * ) Notice: Subject to any disclaimer, the term of this patent is extended or adjusted under 35 U.S.C. 154(b) by 176 days.

(21) Appl. No.: 12/840,759

(22) Filed: Jul. 21, 2010

(65) Prior Publication Data

US 2012/0018444 A1 Jan. 26, 2012

(51) Int. Cl.
*B65D 43/16* (2006.01)

(52) U.S. Cl.
USPC ..... 220/833; 220/793; 215/274; 215/273

(58) Field of Classification Search
USPC ..... 220/833, 835, 315, 320, 820, 793, 220/810; 215/201, 220–225, 274, 298, 329, 215/219, 273, 337
See application file for complete search history.

(56) References Cited

U.S. PATENT DOCUMENTS

| | | | | | |
|---|---|---|---|---|---|
| 3,450,290 | A * | 6/1969 | Turner | 215/225 |
| 3,469,725 | A * | 9/1969 | Turner | 215/225 |
| 3,581,925 | A * | 6/1971 | Thornton et al. | 215/225 |
| 3,584,760 | A * | 6/1971 | Grinker | 220/375 |
| 3,765,578 | A * | 10/1973 | Stull | 222/546 |
| 3,773,204 | A * | 11/1973 | Stroud | 215/225 |
| 3,811,589 | A * | 5/1974 | Thornton et al. | 215/225 |
| 3,850,326 | A * | 11/1974 | Ryles | 215/224 |
| 3,901,400 | A * | 8/1975 | Westfall | 215/221 |
| 3,966,082 | A * | 6/1976 | Hopkins | 220/793 |
| 4,385,706 | A * | 5/1983 | Freeman | 215/225 |
| 4,500,005 | A * | 2/1985 | Forrester | 215/203 |
| 4,512,485 | A * | 4/1985 | Agbay et al. | 215/225 |
| D279,651 | S * | 7/1985 | Freeman | D9/503 |
| 4,941,580 | A * | 7/1990 | Julian | 215/235 |
| 5,040,691 | A * | 8/1991 | Hayes et al. | 215/216 |
| 5,065,876 | A * | 11/1991 | Joyce | 215/206 |
| 6,371,316 | B1 * | 4/2002 | Herr et al. | 215/204 |

* cited by examiner

*Primary Examiner* — Steven A. Reynolds
(74) *Attorney, Agent, or Firm* — Harness, Dickey & Pierce, P.L.C.

(57) ABSTRACT

A closure configured to be engaged with a container, wherein the closure includes a cap and a twist ring. According to aspects of the disclosure, the cap may include: a generally cylindrical main body, a lid, a sidewall extending substantially perpendicularly from the lid, a hinge which allows the lid to pivot between a closed position and an open position, and a lift tab configured to protrude outwardly from the cap. According to aspects of the disclosure, the twist ring may be configured to extend around the cap. Further the twist ring may include: a generally cylindrical main body, a rim extending in a substantially horizontal plane and a sidewall extending substantially vertically from the rim. According to aspects of the disclosure, the twist ring may be configured to be rotated in order to be positioned to selectively prevent the lid of the cap from being pivoted from the closed position to the open position.

20 Claims, 7 Drawing Sheets

CLOSURE

FIELD OF THE DISCLOSURE

Aspects of the present disclosure generally relate to closures. Particular aspects of the present disclosure relate to child resistant closures for containers.

BACKGROUND

Closures are known in that art. Some closures include child resistant features which attempt to prevent children from opening a container with which the closure is configured to be engaged.

SUMMARY

The present disclosure generally relates to new and novel structures for closures. For example, aspects of the disclosure relate to a closure configured to be engaged with a container, wherein the closure includes a cap and a twist ring. According to aspects of the disclosure, the cap may include: a generally cylindrical main body, a lid, a sidewall extending substantially perpendicularly from the lid, a hinge which allows the lid to pivot between a closed position and an open position and a lift tab configured to protrude outwardly from the cap. According to aspects of the disclosure, the twist ring may be configured to extend around the cap. Further the twist ring may include: a generally cylindrical main body, a rim extending in a substantially horizontal plane and a sidewall extending substantially vertically from the rim. According to aspects of the disclosure, the twist ring may be configured to be rotated in order to be positioned to selectively prevent the lid of the cap from being pivoted from the closed position to the open position.

The above summary presents general aspects of the disclosure in order to provide a basic understanding of at least some of its aspects. The summary is not intended as an extensive overview of the disclosure. It is not intended to identify key or critical elements of the disclosure or to delineate the scope of the disclosure. The above summary merely presents some concepts of the disclosure in a general form as a prelude to the more detailed description provided below.

BRIEF DESCRIPTION OF THE DRAWINGS

A more complete understanding of the present disclosure and certain advantages thereof may be acquired by referring to the following description in consideration with the accompanying drawings, in which like reference numbers indicate like features, and wherein.

DETAILED DESCRIPTION

In the following description of various example embodiments of the disclosure, reference is made to the accompanying drawings, which form a part hereof, and in which are shown by way of illustration various example structures and systems in which aspects of the disclosure may be practiced. It is to be understood that other specific arrangements of parts, structures, example devices, systems, and the like may be utilized and structural and functional modifications may be made without departing from the scope of the present disclosure. When the same reference number appears in more than one drawing, that reference number is used consistently in this specification and the drawings to refer to the same or similar parts throughout.

Child resistant closures are primarily focused on preventing children from opening containers. For example, in some circumstances, containers may contain items that may be harmful to children (e.g., prescription drugs, cleaning materials, etc.) However, while child resistant closures should prevent children from opening containers, such child resistant closures should also allow adults to easily open and close the containers. For example, a child resistant closure should not require an excessive amount of force in order to open the container. It may be difficult for elderly or infirm persons to generate a large amount of force and, therefore, they would find it difficult to open a container if the container was closed with a child resistant closure that requires an excessive amount of force in order to open the container. If an adult finds it difficult to open a container, then the adult may not fully close the container in order to avoid the difficulty the next time the adult has to open the container. Yet, such a situation would defeat the purpose of child resistant closures in the first place. Therefore, aspects of the disclosure relate to child resistant closures which are relatively easy for an adult to open (e.g., adults would not be required to generate a large amount of force).

An illustrative embodiment of a closure 1 according to one aspect of the disclosure is shown at FIGS. 1A-1E. Further, in order to provide a frame of reference for the operation of the closure 1, a container 101 to which the closure 1 may be configured to be engaged is also shown in FIGS. 1A-1E.

According to aspects of the disclosure, the closure 1 may include a cap 3 and a twist ring 5. It is noted that while the cap 3 and the twist ring 5 may be engaged to form the closure 1, according to aspects of the disclosure, the cap 3 and twist ring 5 may be separate pieces. Each of the cap 3 and twist ring 5 will be described briefly immediately below in order to provide the reader with a basic understanding of the disclosure. Each of the cap 3 and twist ring 5 will be described in detail further below.

Figure 1A:
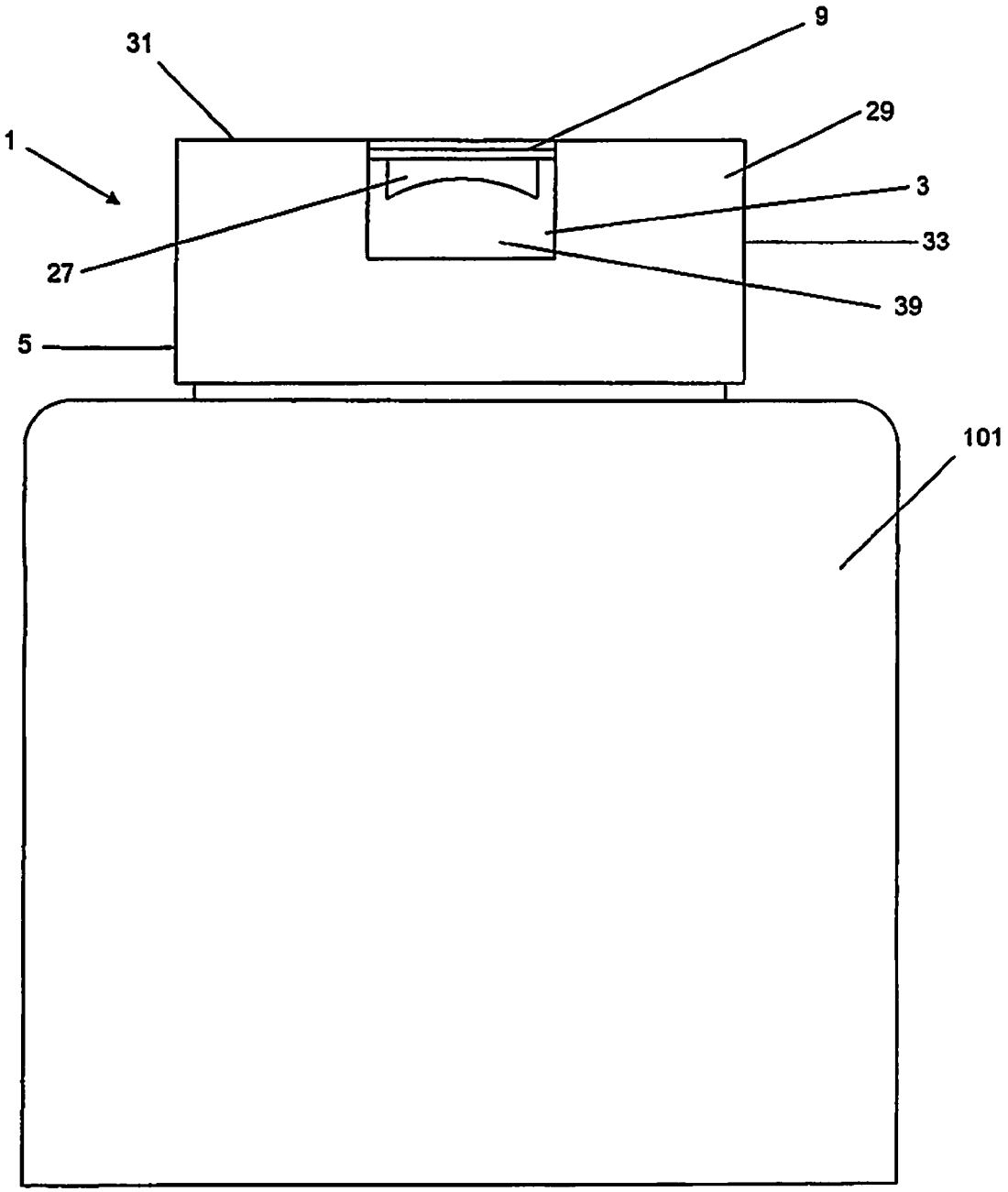
FIG. 1A illustrates a closure according to at least one aspect of the disclosure wherein the closure is arranged in a closed and unlocked state.
Figure 1B:
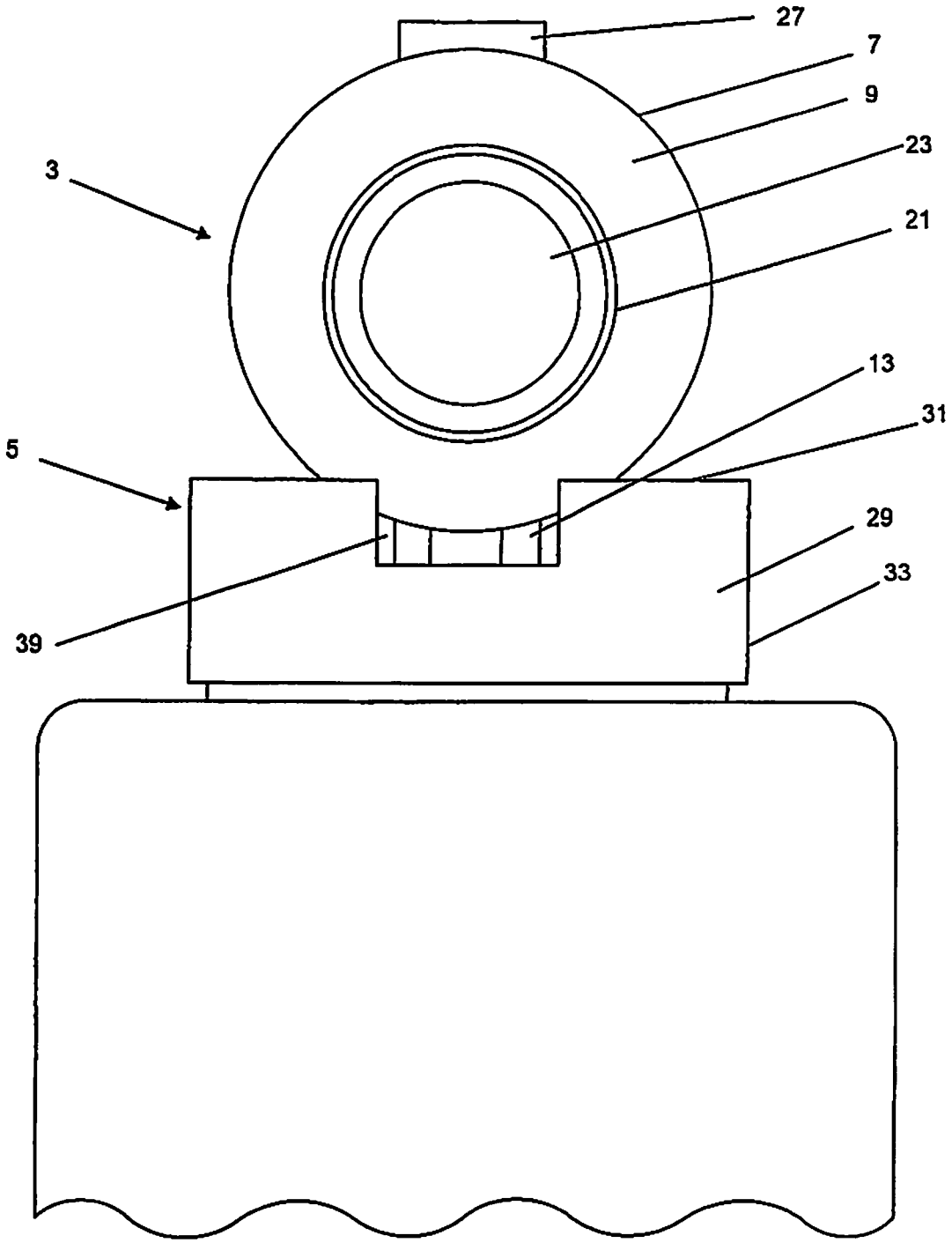
FIG. 1B illustrates the closure of FIG. 1A wherein the closure is arranged in an open position.

According to aspects of the disclosure, and as seen in FIGS. 1A and 1B, the cap 3 may include a generally cylindrical main body 7 including a top or lid 9. Further, the generally cylindrical main body 7 may include a sidewall 11 extending substantially perpendicularly from the lid 9. Additionally, according to aspects of the disclosure, and as seen most clearly in FIG. 1B, the cap 3 may include a hinge 13 which allows the lid 9 to pivot. Therefore, according to aspects of the disclosure, the lid 9 may pivot between closed position (as seen in FIG. 1A) and open position (as seen in FIG. 1B). When the lid 9 is in the closed position, the lid 9 extends in a substantially horizontal plane and the user is prevented from accessing the contents of the container 101. When the lid 9 is in the open position, the lid 9 extends in a substantially vertically plane and the contents of the container 101 are accessible to the user.

Further, according to aspects of the disclosure, and as seen in FIGS. 1A and 1B, the cap 3 may include a lift tab 27. For example, the lift tab 27 may be positioned on an outer circumference of the sidewall 11 of the main body 7 wherein the sidewall 11 meets the lid 9. As seen in FIGS. 1A and 1B, the lift tab 27 may be configured to protrude outwardly from the cap 3. For example, when the lid 9 is in the closed position, the lift tab 27 may extend out from the lid 9 in a horizontal direction and resemble a ledge or "duck bill" under which a user could position a finger or thumb to provide a force on the underside of the lift tab 27 to pivot the lid 9 of the cap 3 from a horizontal, closed position to a vertical, open position.

As discussed above, according to aspects of the disclosure, the closure 1 may also include a twist ring 5. According to aspects of the disclosure, and as seen in FIGS. 1A and 1B, the twist ring 5 may be configured to extend around the cap 3 of the closure 1. For example, according to aspects of the disclosure, and as seen in FIGS. 1A-1E, the twist ring 5 may include a generally cylindrical main body 29. Further, the generally cylindrical main body 29 of the twist ring 5 may include a rim 31 extending in a substantially horizontal plane (as most clearly seen in FIGS. 1C and 1E) and a sidewall 33 extending substantially vertically from the rim 31 (as most clearly seen in FIGS. 1A, 1B and 1D).

According to aspects of the disclosure, the twist ring 5 may be configured to selectively prevent the lid 9 of the cap 3 from being pivoted from the closed position to the open position. For example, according to aspects of the disclosure (as most clearly seen in FIG. 1E), the rim 31 of the twist ring 5 may be configured to extend over at least a portion of the cap 3 (e.g., the lift tab 27) and, thereby, prevent the lid 9 of the cap 3 from being pivoted from the closed position to the open position. Conversely, according to aspects of the disclosure, the twist ring 5 may be configured to selectively allow the user access to the lid 9 of the cap 3 and, thereby, allow the user to pivot the lid 9 from the closed position to the open position.

Figure 1C:
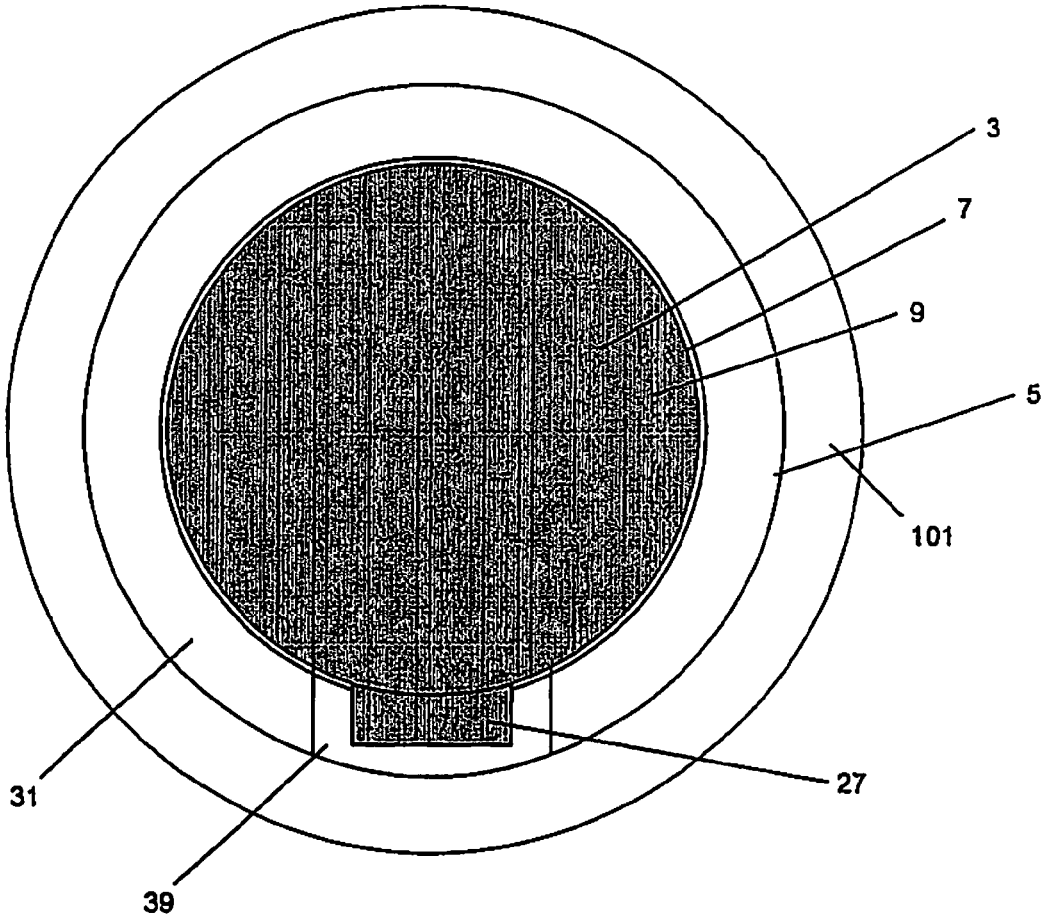
FIG. 1C illustrates a top view of the embodiment of the closure shown in FIG. 1A.
Figure 1D:
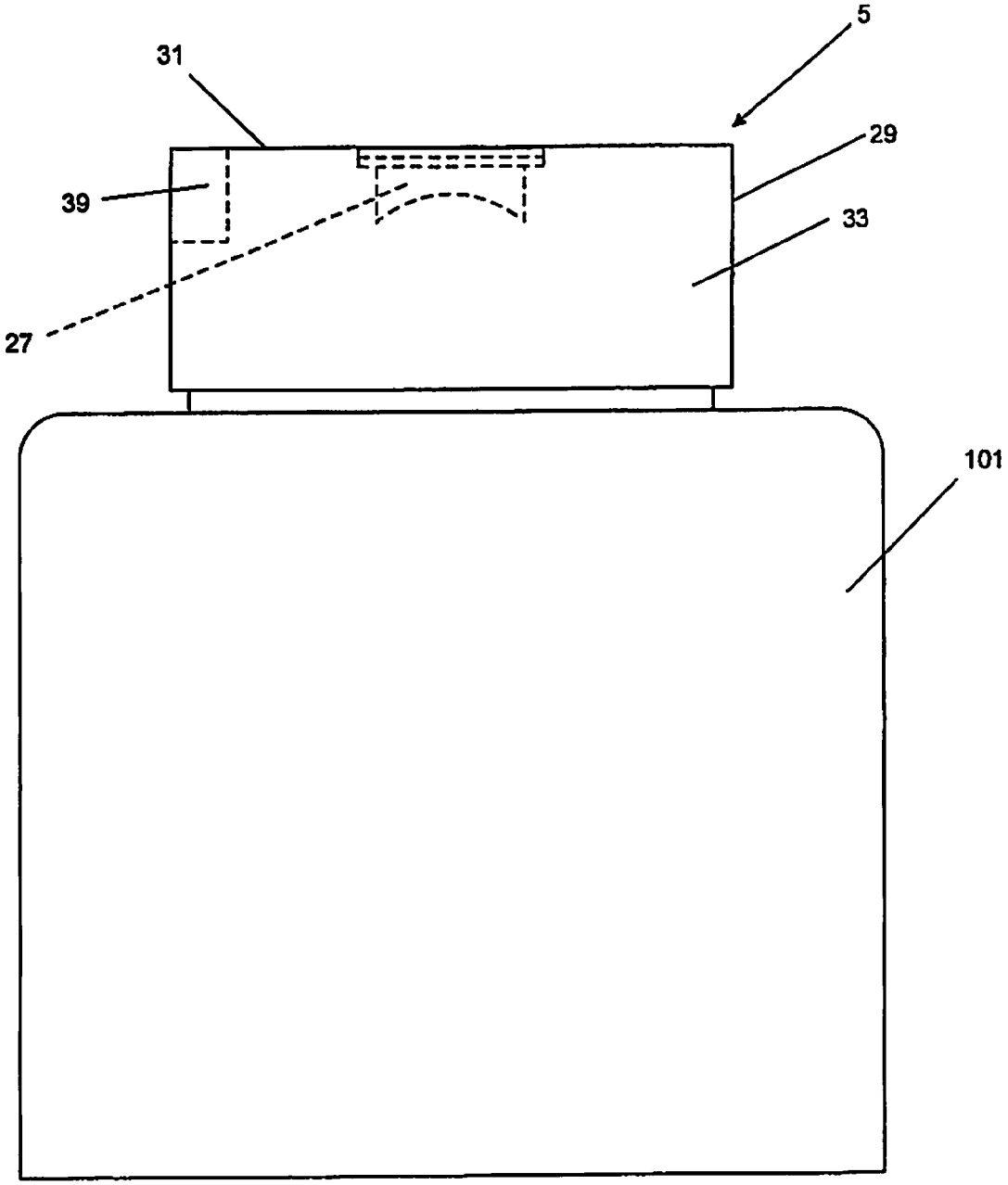
FIG. 1D illustrates the closure of FIG. 1A wherein the closure is arranged in a closed and locked state.
Figure 1E:
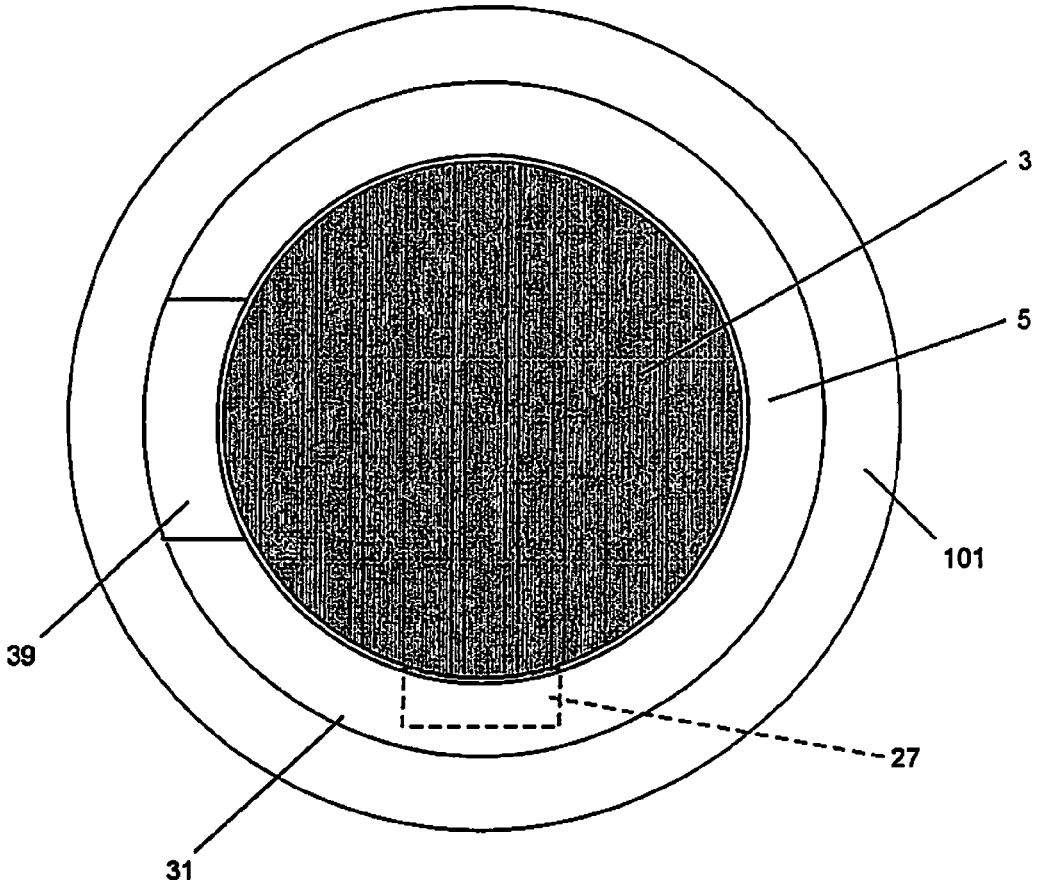
FIG. 1E illustrates a top view of the embodiment of the closure shown in FIG. 1D.

For example, according to aspects of the disclosure, the twist ring 5 may include an opening or recess 39 in the sidewall 33 of the generally cylindrical main body 29. According to aspects of the disclosure, and as seen in FIGS. 1A and 1C, the twist ring 5 may be rotated to a position wherein the opening 39 in the sidewall 33 is aligned with the lift tab 27 of the cap 3. Once the opening 39 of the twist ring 5 and lift tab 27 of the cap 3 are aligned, the user may provide a force on the underside of the lift tab 27 in order to pivot the lid 9 of the cap 3. Therefore, the closure 1 may be opened and, hence, access to the contents of the container 101 is provided. On the other hand, and as seen in FIGS. 1D-1E, if the opening 39 of the twist ring 5 is not aligned with lift tab 27 of the cap 3, the rim 31 of the twist ring 5 may be configured to extend over the lift tab 27 and, thereby, prevent the lid 9 of the cap 3 from being pivoted from the closed position to the open position. Therefore, the closure 1 cannot be opened and, hence, the user cannot access to the contents of the container 101.

The above described configuration of the closure 1 allows the closure to be child resistant, because the closure 1 allows the user to open the closure 1 only when the opening 39 of the twist ring 5 and lift tab 27 of the cap 3 are aligned. This configuration is advantageous for the elderly, infirm, etc., because they do not have to provide a large amount of force to open the container 101. Instead, they merely have to rotate the closure 1 to the appropriate position and apply a much smaller amount of force to open the container 101.

According to aspects of the disclosure, the closure 1 may include additional child resistant features. For example, the closure 1 may be configured so that the cap 3 rotates with the twist ring 5, unless the twist ring 5 is selectively disengaged from the cap 3. In other words, according to aspects of the disclosure, the cap 3 may be engaged with the twist ring 5 in such a manner that when the twist ring 5 is rotated, the cap 3 rotates along with the twist ring 5. In this way, because the cap 3 and the twist ring 5 are rotating together, the cap 3 cannot rotate relative to the twist ring 5. Therefore, in such cases, wherein the twist ring 5 is selectively engaged with the cap 3, the opening 39 of the twist ring 5 cannot be aligned with lift tab 27 of the cap 3. Hence, the rim 31 of the twist ring 5 remains extended over the lift tab 27 and, as described above, the lid of the closure 1 cannot be opened. As a result, the user cannot gain access to the contents of the container 101.

However, according to aspects of the disclosure, the twist ring 5 may also be selectively disengaged from the cap 3. By disengaging the twist ring 5 from the cap 3, the twist ring 5 may be rotated relative to the cap 3 (i.e., the cap 3 remains stationary while the twist ring 5 rotates around it). Therefore, the opening 39 of the twist ring 5 may be aligned with the lift tab 27 of the cap 3. Hence, as described above, the lid 9 of the closure 1 may be opened. As a result, the user can gain access to the contents of the container 101. The operation of the closure 1 with respect to selectively engaging and disengaging the twist ring 5 from the cap 3 will be described in detail below.

Given the general description of various example aspects of the disclosure provided above, more detailed descriptions of various specific example features of closure structures according to the disclosure are provided below.

Figure 2A:
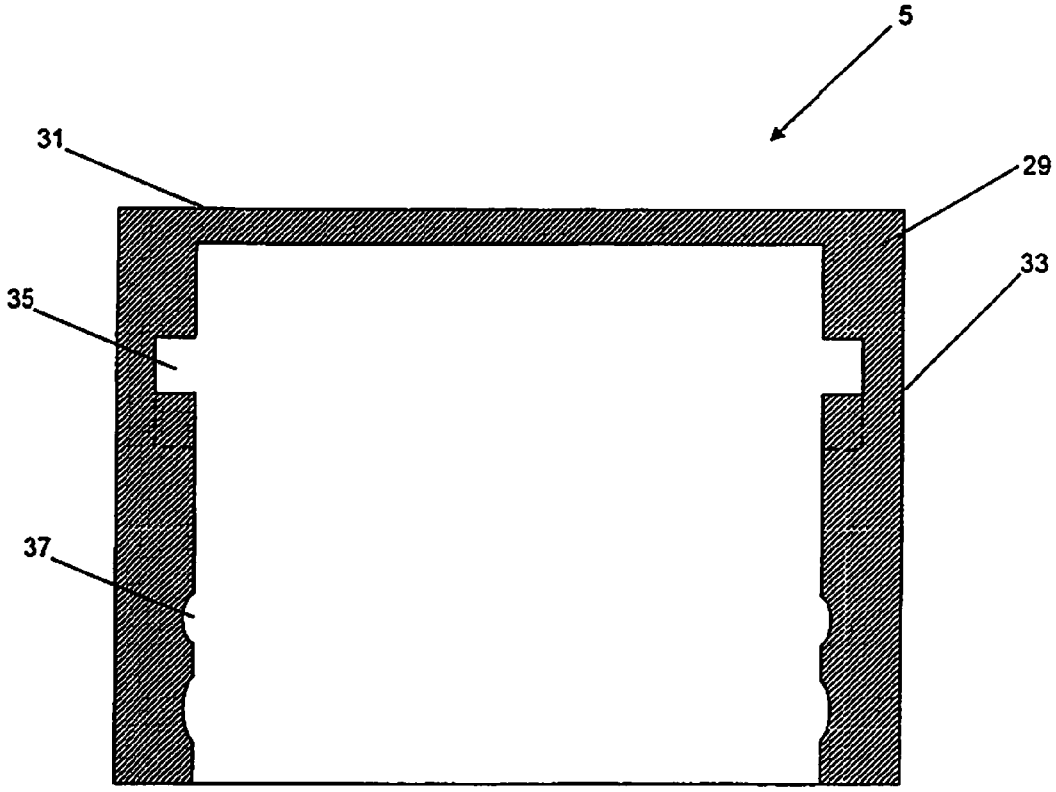
FIG. 2A illustrates a cross-sectional view of an embodiment of a twist ring, wherein portions of the twist ring have been removed for illustrative purposes.

FIG. 2A illustrates a cross sectional view of the twist ring 5 shown in FIG. 10 according to aspects of the disclosure, wherein portions of the twist ring 5 have been removed for illustrative purposes. As shown in FIG. 2A, the twist ring 5 may include a main body 29 which includes a rim 31 and sidewalls 33 which extend from the rim 31. Further, as best seen in FIGS. 1C and 1E, the twist ring 5 may be configured such that it is relatively circular and resembles a cylinder with open and opposite ends. According to aspects of the disclosure, the diameter of the twist ring 5 may be in a range of 1.0-3.0 inches. Further, according to particular aspects of the disclosure, the diameter of the twist ring 5 may be in the range of 1.5-2.0 inches. According to aspects of the disclosure, the height of the twist ring 5 may be in a range of 0.5-2.0 inches. Further, according to particular aspects of the disclosure, the height of the twist ring 5 may be in the range of 0.75-1.0 inches. Additionally, according to some embodiments of this disclosure, the wall thickness of the rim 31 and the sidewalls 33 of the twist ring 5 may be predetermined dimensions in order to provide appropriate rigidity. For example, according to one embodiment, the wall thickness of the rim 31 of the twist ring 5 may be in a range of 0.1-0.2 inches. Further, according to one embodiment, the wall thickness of the sidewalls 33 of the twist ring 5 may be in a range of 0.1-0.2 inches. However, it is noted that the above described dimensions are merely examples. It is understood that the height, diameter and other dimensions of the twist ring 5 may be varied as desired. For example, according to other embodiments, different portions of the twist ring 5 may be made of different dimensions, have different thicknesses, different rigidities, etc.

As discussed above, according to aspects of the disclosure, the twist ring 5 may be configured to engage with the cap 3. According to aspects of the disclosure, and as seen in FIG. 2A, the twist ring 5 may include internal grooves 35 which engage with and selectively rotate with the engaging lugs 25 of the cap 3 (which will be described below). The internal grooves 35 may include portions (e.g., shown in FIG. 2A in dashed line) that are configured to overlap with and engage with the engaging lugs 25 of the cap 3 when the closure 1 is in an uncompressed state that will be described in detail below. Further, the twist ring 5 may include additional internal grooves 37 which engage with and selectively rotate on a transfer bead of the container 101.

Further, as described above, and most clearly seen in FIGS. 1A-1C, the twist ring 5 may include an opening or recess 39 in the sidewall 33 of the generally cylindrical main body 29. For example, according to aspects of the disclosure, the opening 39 may be sized and configured to allow a user to insert a finger through the sidewall 33. In this way, when the twist ring 5 is appropriately aligned with the lift tab 27 of the cap 3, the user may provide a force to the underside of the lift tab 27 in order to pivot the lid 9 of the cap 3 to the open position and provide access to the contents of the container 101. According to aspects of the disclosure, the opening or recess 39 may be approximately 1.0-1.5 inches along the circumference of the twist ring 5. However, the dimensions of the opening or recess 39 may vary as desired.

According to aspects of the disclosure, the twist ring 5 may be made of a plastic material such as polypropylene, high density polyethylene, low density polyethylene, polyethylene terephthalate (PET) or some other type of plastic. For example, the twist ring 5 may be molded. Of course, according to other aspects of the disclosure, the twist ring 5 may be made from other materials as well (e.g., composites, metals, alloys, etc.).

It is noted that, according to aspects of the disclosure, the twist ring 5 may be configured to increase the traction between the user's hand and the surface of the twist ring 5 and, thereby, aid the user in rotating the twist ring 5. For example, twist ring 5 may include surface feature, such as ridges, along the side surface. The twist ring 5 may be configured in other ways as well. Of course, according to other aspects of the disclosure, the twist ring 5 may include a smooth side.

It is noted that the rim 31 of the twist ring 5 may be configured to provide information to the user. For example, according to aspects of this disclose, the twist ring 5 may include one or more indicators which indicate information to the user. For example, the indicators may be visual, sensory (e.g., felt through touch), etc. For example, according to aspects of the disclosure, the top of the twist ring 5 may be configured to include engraving or raised markings. For example, the rim 31 of the twist ring 5, may be configured with engravings or raised markings that include words, phrases, symbols, etc. that convey information to the user. For example, the engravings or raised markings may provide instructions to the user, such as "PALM AND TURN TO OPEN" or arrows in a counter clockwise direction to indicate the direction to rotate the twist ring 5 to selectively disengage it from the cap 3. Of course, other lettering may be used as well. For example, the lettering may include the expiration date of the substance in the container 101. Further, other indicators may be used as well. For example, alternatively, or, in addition to, the engraving or raised markings, the closure may include Braille or other indicators. Further, it is understood that the indicators may be positioned on portions of the closure 1 other than the top.

Figure 2B:
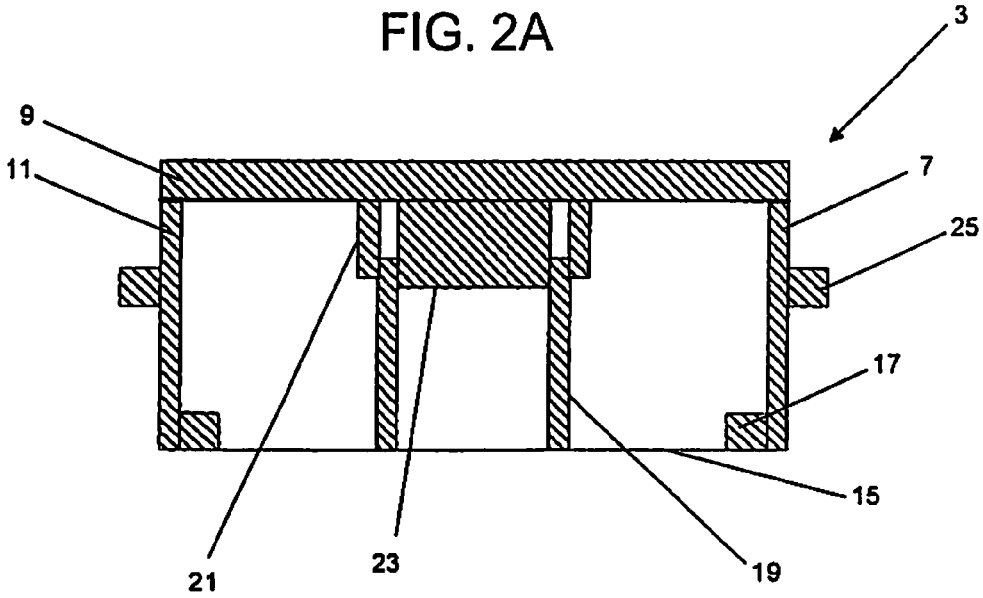
FIG. 2B illustrates a cross-sectional view of an embodiment of a cap, wherein portions of the cap have been removed for illustrative purposes.

FIG. 2B illustrates a cross sectional view of the cap 3 shown in FIG. 1 according to aspects of the disclosure, wherein portions of the cap 3 have been removed for illustrative purposes. As described above, and as shown in FIG. 2B, the cap 3 may have a generally cylindrical main body 7 including a lid 9 that extends substantially horizontally and sidewall 11 extending substantially vertically from the lid 9.

According to aspects of the disclosure, the diameter of the cap 3 may be in a range of 1.0-2.9 inches. Further, according to particular aspects of the disclosure, the diameter of the cap 3 may be in the range of 1.5-1.9 inches. According to aspects of the disclosure, the height of the cap 3 may be in a range of 0.5-2.0 inches. Further, according to particular aspects of the disclosure, the height of the cap 3 may be in the range of 0.75-1.0 inches. Additionally, according to some embodiments of this disclosure, the wall thickness of the lid 9 and the sidewalls 11 of the cap 3 may be predetermined dimensions in order to provide appropriate rigidity. For example, according to one embodiment, the wall thickness of the lid 9 of the cap 3 may be in a range of 0.1-0.2 inches. Further, according to one embodiment, the wall thickness of the sidewalls 11 of the cap 3 may be in a range of 0.1-0.2 inches. However, it is noted that the above described dimensions are merely examples. It is understood that the height, diameter and other dimensions of the cap 3 may be varied as desired. For example, according to other embodiments, different portions of the cap 3 may be made of different dimensions, have different thicknesses, different rigidities, etc.

According to aspects of the disclosure, the hinged cap 3 may be a "snap" cap. In other words, the hinged cap 3 may include an engaging mechanism which retains the lid 9 in a closed position when the lid 9 has been closed. An example of a suitable engaging mechanism for creating a "snap" cap includes snap fit protrusions which releasably snap into, and mate with, corresponding detents, wherein the protrusions and detents are positioned on opposite corresponding portions of the cap 3. Other suitable engaging mechanisms (e.g., friction fit) may be used and are well know in the art and, therefore, will not be described in detail here.

According to aspects of the disclosure, the cap 3 may be configured to be relatively permanently engaged with the container 101. For example, according to aspects of the disclosure, the cap 3 may include a skirt configured to engage the container 101 and prevent the cap 3 from being disengaged from the container 101. For example, as seen in FIG. 2B, the skirt may include a ring 17 positioned on the inner circumference of the sidewall 11 of the main body 7. The ring 17 may be configured to protrude inwardly to the center of the cap 3. In this way, the ring 17 may be engaged with a corresponding structure on the neck of the container 101 to prevent the cap 3 from being disengaged from the container 101. For example, the container 101 may include a similar ring (or portions thereof) positioned on the outer circumference of the neck of the container 101. Therefore, when engaged (e.g., when the ring 17 is pushed over or past the corresponding structure on the neck of the container 101) the ring 17 and the corresponding structure on the neck of the container 101 may overlap and, thereby, interfere with each other to prevent the cap 3 from being disengaged from the container 101.

As seen in FIG. 2B, the cap 3 may also include a base 15. The base 15 may be configured to allow the container 101 to engage with the cap 3. For example, the base may include holes or orifices to allow the container 101 to engage with the cap 3.

Further, according to aspects of the disclosure, and as seen in FIG. 2B, the cap 3 may also include a pintle 19. For example, as seen in FIG. 2B, the pintle 19 may be configured to extend upwards from the base 15 of the cap 3. Further, according to aspects of the disclosure, the pintle 19 may be a dispensing pintle. For example, liquid or other contents of the container 101 may be dispensed through the dispensing pintle 19. According to aspects of the disclosure, the pintle 19 may be sealed with foil or some other substance in order to provide a tamper evident feature.

Further, according to aspects of the disclosure, and as seen in FIG. 2B, the cap 3 may include a second pintle 21. For example, as seen in FIG. 2B, the second pintle 21 may be configured to extend downwards from the bottom of the lid 9 of the cap 3. Further, according to aspects of the disclosure, the pintle 21 may be configured to engage with the dispensing pintle 19. For example, as seen in FIG. 2B, the pintle 21 may surround the dispensing pintle 19 when the lid 9 of the cap 3 is positioned in the closed position. This may aid in sealing the dispensing pintle 19 and preventing containments, moisture, air, etc. from reaching the contents of the container 101.

Further, according to aspects of the disclosure, and as seen in FIG. 2B, the cap 3 may include a seal 23. For example, the seal 23 may be a linerless plug seal. According to aspects of the disclosure, and as seen in FIG. 2B, the plug seal 23 may be configured to extend downwards from the bottom of the lid 9 of the cap 3. Further, according to aspects of the disclosure, the plug seal 23 may be configured to engage with the dispensing pintle 19. For example, the plug seal 23 may fit into the interior of an orifice of the dispensing pintle 19 when the lid 9 of the cap 3 is positioned in the closed position. This may aid in sealing the dispensing pintle 19 and preventing containments, moisture, air, etc. for reaching the contents of the container 101. According to aspects of the disclosure, the plug seal 23 may be comprised of NEOPRENE® (manufactured by E.I. du Pont de Nemours and Company of Wilmington, Del.) or other rubber materials. For example, according to aspects of the disclosure, the cap 3 may be created via a co-injection molding process wherein the different materials are co-injected (e.g., double shot). Additionally, according to aspects of the disclosure, the cap 3 may be made of polypropylene, high density polyethylene, low density polyethylene, polyethylene terephthalate (PET), etc., and the plug seal 23 may be coated in NEOPRENE® or another rubber material. For example, according to aspects of the disclosure, the NEOPRENE® or other rubber material may extend over a portion of the cap 3 that comprises the structure of the plug seal 23, or, alternatively, extend over the entire or substantially the entire potion of the cap 3 that comprises the base of the plug seal 23.

Further, according to aspects of the disclosure, the cap 3 may include one or more engaging lugs 25 configured to selectively engage the twist ring 5 and, thereby, cause the cap 3 to rotate with twist ring 5 as described above. For example, the engaging lugs 25 may be positioned on an outer circumference of the sidewall 11 of the main body 7. As seen in FIG. 2B, according to aspects of the disclosure, the engaging lugs 25 may be configured to protrude outwardly from the cap 3. In this way, the engaging lugs 25 may be selectively engaged with the corresponding internal grooves 35 on the inner circumference of the twist ring 5 to cause the cap 3 to rotate with the twist ring 5.

According to aspects of the disclosure, the one or more lugs 25 may be molded as an integral part of the cap 3. Further, according to aspects of the disclosure, the lugs 25 may be evenly spaced around the outer circumference of the sidewall 11 of the cap 3. According to the aspects of the disclosure, cap 3 may include six lugs 25 that are spaced 60° apart around the outer circumference of the sidewall 11 of the cap 3. Of course, this is merely one embodiment, and according to other aspects of the disclosure, the number of lugs 25 and/or the spacing of the lugs 25 may be varied as desired. Further it is noted that respective engaging portions of the internal groove 35 may be varied to correspond to the arrangement of the lugs 25. According to aspects of the disclosure, the lugs 25 may be configured to have a shape with flat, horizontal surfaces, such as cube. Of course, this is merely one embodiment of the lugs 25 and other shapes could be provided as desired. For example, the lugs may be tapered in various directions. According to aspects of the disclosure, the width of the lugs 25 (in the direction extending outwards from the sidewall 11) may be in a range of 0.1-0.2 inches. According to aspects of the disclosure, the height of the lugs 25 may be in a range of 0.05-0.1 inches.

As mentioned above, the lugs 25 are configured to engage with corresponding internal grooves 35 that are molded into the twist ring 5 and positioned around the inner circumference of twist ring 5 in order to make the closure child resistant as described below. Further, as mentioned above, the internal grooves 35 may include portions that are configured to overlap with and engage with the engaging lugs 25 of the cap 3 when the closure is in an uncompressed state that will be described in detail below. Additionally, as described in detail below, the internal grooves 35 and engaging lugs 25 may be configured to disengage when the closure 1 is compressed. Hence, when the downward force is applied to the twist ring 5, the internal grooves 35 are moved downwardly and the lugs 25 "clear" those portions of the internal grooves 35 that are configured to overlap with and engage with the engaging lugs 25 when the closure 1 is in an uncompressed state. Therefore, when the twist ring 5 is disengaged from the cap 3, the twist ring 5 may be rotated and the cap 3 will not rotate. It is noted that instead of lugs 25 other configurations may be used e.g., a ring. Of course the structure of the twist ring 5 should be adjusted accordingly to accommodate the structure of the cap 3.

As described above, according to aspects of the disclosure, the cap 3 may include a lift tab 27. The lift tab 27 may be configured to protrude outwardly from the cap 3. According to aspects of the disclosure, and as seen most clearly in FIGS. 1A and 11), the lift tab 27 may be configured to receive the user's finger or thumb. For example, the lift tab 27 may include a tapered underside.

According to aspects of the disclosure, the cap 3 may be made of a plastic material such as polypropylene, high density polyethylene, low density polyethylene, polyethylene terephthalate (PET) or some other type of plastic. For example, the cap 3 may be molded. Of course, according to other aspects of the disclosure, the twist ring 5 may be made from other materials as well (e.g., composites, metals, alloys, etc.).

Figure 3A:
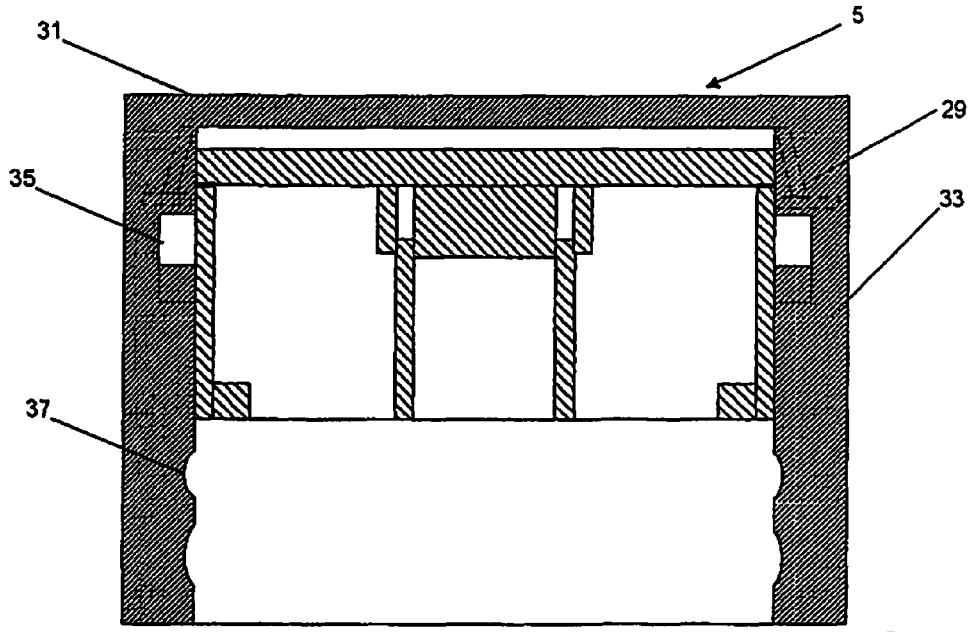
FIG. 3A illustrates a cross-sectional view of an embodiment of a closure in an uncompressed state, wherein portions of the twist ring and cap have been removed for illustrative purposes.
Figure 3B:
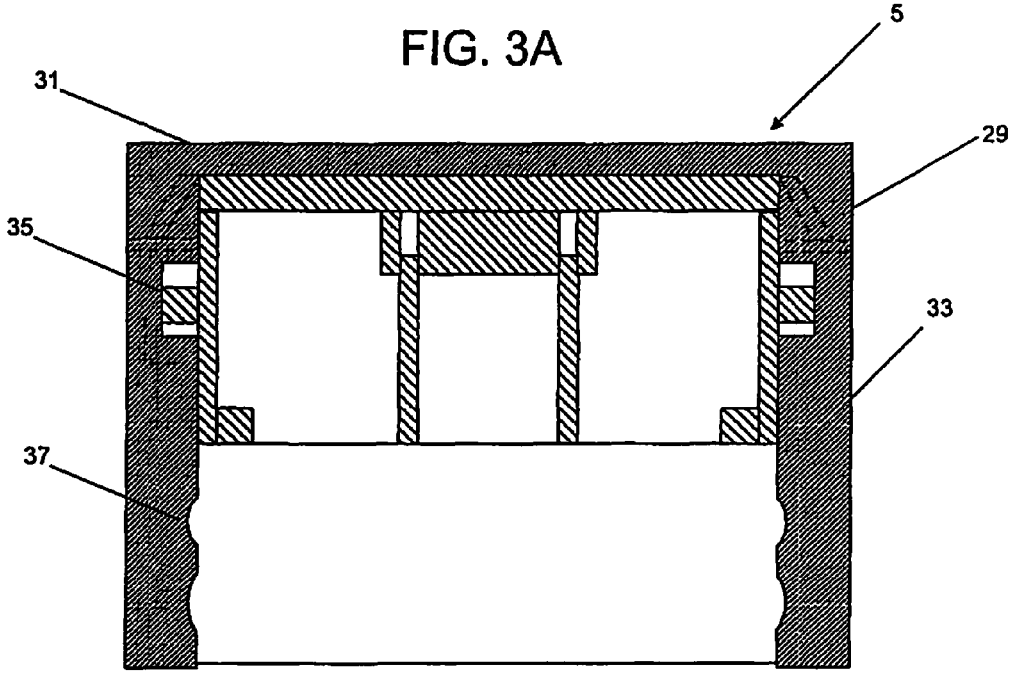
FIG. 3B illustrates a cross-sectional view of an embodiment of a closure in a compressed state, wherein portions of the twist ring and cap have been removed for illustrative purposes.

The operation of the closure 1 with respect to selectively engaging and disengaging the twist ring 5 from the cap 3 will be described in detail below. FIGS. 3A and 3B illustrate a closure 1 according to at least one aspect of the disclosure wherein the cap 3 and the twist ring 5 are engaged. Portions of the closure 1 are shown in cross-section for illustrative purposes. Further, portions of the closure 1 and the container 101 have been removed for illustrative purposes. However, it is noted that while not shown it is understood, that according to aspects of the disclosure, the container 101 may provide a biasing force against the cap 3 during compressed and uncompressed states. FIG. 3A illustrates the closure 1 in the unstressed/uncompressed state. FIG. 3B illustrates the closure 1 when a force has been applied to the top of the closure (e.g., as a force would be when opening the container).

Initially, when the container 101 is closed, the closure 1 and the container 101 are engaged with the twist ring 5 and the cap 3 being in the closed position, wherein the opening 39 of the twist ring 5 is not aligned with the lift tab 27 of the cap 3, as shown in FIGS. 1D and 1E. Further, the closure 1 is in the uncompressed state shown in FIG. 3A. Therefore, to open the container 101, the user may grasp the container 101 with a first hand and apply a force to the top of the closure 1 with a second hand (e.g., a downward force provided by the palm of the second hand). According to aspects of the disclosure, the force may be applied to the rim 31 of the twist ring 5. Upon a sufficient force being applied to the rim 31 of the twist ring 5, the twist ring 5 will move closer towards the cap 3 and, therefore, the internal grooves 35 of the twist ring 5 will be moved to a level whereby the lugs 25 of the cap 3 may be disengaged from the portions of the internal grooves 35 of the twist ring 5 which they engage in the uncompressed state (as shown in the compressed state of the closure 1 seen in FIG. 3B). Hence, once a user has provided a sufficient force to the top of the twist ring 5, the user will be able to rotate the twist ring 5 relative to the cap 3 because the lugs 25 of the cap 3 are no longer engaged with the potions of internal grooves 35 of the twist ring 5 which they engage in the uncompressed state. Thereafter, the user will be able to rotate the twist ring 5 relative to the cap 3 in order to align the opening 39 of the twist ring 5 with the lift tab 27 of the cap 3, as shown in FIGS. 1A and 1C. Thereby, the user will be able to open the lid 9 of the closure 1 and gain access to the contents of the container 101 as shown in FIG. 1B.

It is noted that unless the downward force is applied to the top of the closure 1 (e.g., the rim 31 of the twist ring 5), the lugs 25 of the cap 3 will not be disengaged from the internal grooves 35 of the twist ring 5 and, hence, the twist ring 5 and the cap 3 will idly rotate together instead of rotating relative to each other. In this way, the closure is considered child resistant.

Further, according to aspects of the disclosure, the closure 1 may include a spring force to ensure the twist ring 5 remains engaged with the cap 3 when the closure is in an uncompressed state. According to aspects of the disclosure, the closure 1 may include a segmented ring that extends from the underside of the top of the closure 1. For example, the segmented ring may comprise a plurality of flanges (shown in dashed line in FIGS. 3A and 3B) that each extend from the underside of the top of the closure 1 (e.g., the underside of the rim 31) and, further, may be positioned in a ring like shape corresponding to the circumference of the circular shape of the closure 1. According to aspects of the disclosure, the flanges may be molded as an integral part of the closure 1. Further, according to aspects of the disclosure, the flanges may be evenly spaced in a ring like shape extending from the underside of the top of the closure 1.

According to aspects of the disclosure, the flanges may be configured to have a shape resembling a fin. For example, the flanges may be tapered such that they become narrower as they extend away from the underside of the top of the closure 1. Of course, this is merely an illustrative embodiment and according to other embodiments of the disclosure, the flanges may be configured differently. According to aspects of the disclosure, the flanges may be angled relative to the vertical direction. For example, the flanges may extend in a direction diagonally away from the center of the closure 1 towards the side wall of the closure 1. According to aspects of the disclosure, the length of the flanges may be in a range of 0.1-0.2 inches. Further, according to aspects of the disclosure, the thickness of the flanges may be in a range of 0.01-0.04 inches. However, it is noted that, of course, the dimensions of the flanges may be varied as desired. According to aspects of the disclosure, the flanges may function as a spring feature of the closure 1 to push the twist ring 5 away from the cap 3 when the closure is in the uncompressed state. The flanges may engage against a portion of the cap 3 (e.g., a flange extending outwards from the sidewall 11 of the cap 3; shown in dashed line in FIGS. 3A and 3B). The spring force urges the twist ring 5 upward so that unless the downward force is provided, the lugs 25 of the cap 3 will not clear the engaging portions of the internal grooves 35 of the twist ring 5 and, as a result, the cap 3 will rotate with the twist ring 5. In this way, the closure 1 will be child resistant. Of course, other spring features (e.g., a plastic compressible disc) may be used as well.

While the disclosure has been described with respect to specific examples including presently preferred modes of carrying out the disclosure, those skilled in the art will appreciate that there are numerous variations and permutations of the above described structures and methods. For example, of course, the above recited dimensions are not intended to be limiting and the dimensions of a particular closure according to aspects of this disclosure could be varied based on the particular purpose for which that particular dispensing device is intended. Further, it is noted that the embodiments described herein are merely illustrative. Of course, numerous other embodiments are contemplated and considered within the scope of the disclosure. For example, the particular measurements recited in this disclosure and in the drawings describe a single embodiment of the disclosure. Many other embodiments with different dimensions (e.g., different lengths, different volume capacities, etc.) are considered within the scope of the disclosure. Thus, the spirit and scope of the disclosure should be construed broadly.

The invention claimed is:

1. A closure configured to be engaged with a container to selectively cover an opening to an interior of the container, the opening having a longitudinal axis, the closure comprising:

a cap, including:

a generally cylindrical main body;

a lid;

a sidewall extending substantially perpendicularly from the lid;

a hinge which allows the lid to pivot between a closed position and an open position; and a lift tab configured to protrude outwardly from the cap; and a twist ring configured to extend around the cap, including:

a generally cylindrical main body;

a rim extending in a substantially horizontal plane; and a sidewall extending substantially vertically from the rim, the sidewall configured to engage the container, wherein the twist ring is configured to be rotated in order to be positioned to selectively prevent the lid of the cap from being pivoted from the closed position to the open position, wherein the twist ring is configured to be compressed toward the interior of the container and toward the cap along the longitudinal axis in order to allow rotation of the twist ring relative to the cap, and wherein the twist ring further comprises an opening or recess in the sidewall of the generally cylindrical main body and is configured to be rotated relative to the cap to a position wherein the opening or recess in the sidewall is aligned with the lift tab of the cap, whereupon the cap is pivotable from the closed position to the open position.

2. The closure of claim 1, wherein the rim of the twist ring is configured to extend over at least a portion of the cap when the twist ring is positioned to prevent the lid of the cap from being pivoted from the closed position to the open position.

3. The closure of claim 1, wherein the rim of the twist ring is configured to extend over the lift tab when the twist ring is positioned to prevent the lid of the cap from being pivoted from the closed position to the open position.

4. The closure of claim 1, wherein the closure is configured such that the cap rotates with the twist ring, unless the twist ring is selectively disengaged from the cap.

5. The closure of claim 4, wherein the closure is configured such that the twist ring rotates relative to the cap, when the twist ring is selectively disengaged from the cap.

6. The closure of claim 1, wherein the twist ring further comprises internal grooves which engage with and selectively rotate with engaging lugs positioned on the cap.

7. The closure of claim 6, wherein the engaging lugs positioned on the cap are configured to be disengaged from the internal grooves when the twist ring is compressed toward the interior of the container and toward the cap, thereby allowing rotation of the twist ring relative to the cap, whereupon the cap is pivotable from the closed position to the open position.

8. The closure of claim 1, wherein the cap includes a skirt with a ring positioned on the inner circumference of the sidewall of the main body wherein the ring is configured to protrude inwardly toward the center of the cap and engage the container to prevent the cap from being disengaged from the container.

9. The closure of claim 1, wherein the cap includes a base and a pintle, wherein the pintle is configured to extend upwards from the base of the cap.

10. The closure of claim 9, wherein the pintle is a dispensing pintle through which contents of the container may be dispensed.

11. The closure of claim 10, wherein the cap includes a second pintle, wherein the second pintle is configured to extend downwards from the bottom of the lid of the cap and engage with the dispensing pintle.

12. The closure of claim 11, wherein the second pintle surrounds the dispensing pintle when the lid of the cap is positioned in the closed position.

13. The closure of claim 10, wherein the cap includes a plug seal, wherein the plug seal is configured to extend downwards from the bottom of the lid of the cap and engage with the dispensing pintle.

14. The closure of claim 13, wherein the plug seal fills an orifice in the dispensing pintle when the lid of the cap is positioned in the closed position.

15. A closure configured to be engaged with a container to selectively cover an opening to an interior of the container, the opening having a longitudinal axis, the closure comprising:

a cap, including:
- a generally cylindrical main body;
- a lid;
- a sidewall extending substantially perpendicularly from the lid;
- a hinge which allows the lid to pivot between a closed position and an open position; and
- a lift tab configured to protrude outwardly from the cap; and a twist ring configured to extend around the cap, including:
- a generally cylindrical main body;
- a rim extending in a substantially horizontal plane;
- a sidewall extending substantially vertically from the rim, the sidewall configured to engage the container; and
- an opening or recess in the sidewall, wherein the closure is configured such that the cap and the twist ring are selectively engaged such that the cap rotates with the twist ring, and wherein the twist ring is configured to be compressed toward the interior of the container and toward the cap along the longitudinal axis to allow rotation of the twist ring relative to the cap to a position wherein the opening or recess in the sidewall is aligned with the lift tab of the cap, whereupon the cap is pivotable from the closed position to the open position.

16. A closure configured to be engaged with a container to selectively cover an opening to an interior of the container, the opening having a longitudinal axis, the closure comprising:

a cap, including:
- a generally cylindrical main body;
- a lid;
- a sidewall extending substantially perpendicularly from the lid;
- a hinge which allows the lid to pivot between a closed position and an open position; and
- a lift tab configured to protrude outwardly from the cap; and a twist ring configured to extend around the cap, including:
- a generally cylindrical main body;
- a rim extending in a substantially horizontal plane; and
- a sidewall extending substantially vertically from the rim, the sidewall configured to engage the container, wherein the twist ring is configured to be rotated in order to be positioned to selectively prevent the lid of the cap from being pivoted from the closed position to the open position, wherein the twist ring is configured to be compressed toward the interior of the container and toward the cap along the longitudinal axis, and wherein the twist ring further comprises internal grooves which engage with and selectively rotate with engaging lugs positioned on the cap, the engaging lugs are configured to be disengaged from the internal grooves when the twist ring is compressed toward the interior of the container and toward the cap, thereby allowing rotation of the twist ring relative to the cap, whereupon the cap is pivotable from the closed position to the open position.

17. The closure of claim 16, wherein the rim of the twist ring is configured to extend over at least a portion of the cap when the twist ring is positioned to prevent the lid of the cap from being pivoted from the closed position to the open position.

18. The closure of claim 16, wherein the rim of the twist ring is configured to extend over the lift tab when the twist ring is positioned to prevent the lid of the cap from being pivoted from the closed position to the open position.

19. The closure of claim 16, wherein the cap includes a base and a pintle, wherein the pintle is configured to extend upwards from the base of the cap.

20. The closure of claim 19, wherein the pintle is a dispensing pintle through which contents of the container may be dispensed.

* * * * *